United States Patent [19]

Morman

[11] Patent Number: 4,495,503

[45] Date of Patent: Jan. 22, 1985

[54] SLOW WAVE ANTENNA

[76] Inventor: William H. Morman, 2311 Telemark, NW., Rochester, Minn. 55901

[21] Appl. No.: 350,481

[22] Filed: Feb. 19, 1982

[51] Int. Cl.[3] ..... H01Q 1/36; H01Q 13/18

[52] U.S. Cl. ..... 343/746; 343/748; 343/768; 343/895

[58] Field of Search ..... 343/895, 788, 767–769, 343/770, 731, 732, 741, 742, 745, 746, 748–750, 789, 829, 830, 841–843, 846–848, 866

[56] References Cited

U.S. PATENT DOCUMENTS

| | | | |
|---|---|---|---|
| 2,816,285 | 12/1957 | Topol | 343/770 |
| 2,866,197 | 12/1958 | Kandoian | 343/895 |
| 3,573,840 | 4/1971 | Gouillou | 343/895 |
| 3,757,345 | 9/1973 | Carver | 343/895 |
| 3,824,600 | 7/1974 | Majkrzak et al. | 343/895 |
| 3,852,759 | 12/1974 | Felsenheld | 343/895 |
| 3,909,757 | 9/1975 | Miyamoto et al. | 343/770 |
| 4,101,899 | 7/1978 | Jones, Jr. et al. | 343/895 |

OTHER PUBLICATIONS

The "ARRL Antenna Book", 14th edition, Chapter 10, pp. 10–11, 10–12.

*Primary Examiner*—Eli Lieberman
*Assistant Examiner*—Michael C. Wimer
*Attorney, Agent, or Firm*—Hugh D. Jaeger

[57] ABSTRACT

Slow wave antenna including slow wave structure of a helical coiled conductor having linear capacitance and inductance distribution. Driving point impedance is changed by varying the ratio of the distributive capacitance to the distributed inductance. Tuning is changed by changing the capacitance between the distributive capacitance common and RF ground. Slow wave antenna structure includes a first embodiment having a slotted pipe with a helically wound conductor and a second embodiment includes a helically coiled element with a plane capacitance structure. In the slotted type of helically wound center conductor antenna, the antenna is tuned by changing the distance between the helix and the outside diameter of the pipe. The antenna is also tuned by changing the capacitance between the pipe and the ground of the RF system. In the helical element with a plane capacitance sheet antenna, tuning is accomplished by varying the spacing of the sheet and hence the capacitance between a conductive sheet and the helix.

8 Claims, 5 Drawing Figures

SLOW WAVE ANTENNA

BACKGROUND OF THE INVENTION

1. Field of the Invention

The present invention relates to a communications antenna, and, more particularly, pertains to a slow wave structure in a slow wave antenna.

2. Description of the Prior Art

Historically, antenna elements of the prior art have been physically shortened below λ/4 (one-quarter wavelength), but as the elements are shortened below λ/4, the element radiation resistance becomes very low and the element exhibits capacitive reactance. In returning a shortened antenna element to electrical resonance, normally an inductive reactance is inserted in series along the length of the element. When the element is used as a simple λ/4 vertical antenna, the series tuning inductance can be positioned at the driving point, in the center, at the end opposite the driving point or distributed along the length of the element. The element is then referred to as being base loaded, center loaded, top loaded, or continuous loaded respectively depending on the positioning of the inductance.

Series inductance returns the shortened antenna element to resonance; however, in the case of an active or driven element, the radiation resistance reflected to the driving point still is quite low. In providing convenient matching to a transmission line, transmitter circuit, or receiver circuit, an impedance matching network is generally required. In any case, the inductively loaded antenna element exhibits a quite high Q and therefore has a quite narrow band width.

The Q is decreased and hence the bandwidth of an inductively loaded antenna element is increased by additional capacitance loading. This capacitance loading is generally accomplished by attaching disks, spikes, spokes or rings to the antenna element at or near the end opposite the driving point. The capacitance loading has the additional advantage of bringing the shortened element to resonance with less series inductive loading.

Practical prior art antennas incorporate physically shortened elements and utilize some type of series inductance and/or series-parallel capacitance loading to return the elements to electrical resonance at or near the operating frequency.

The present invention overcomes the disadvantages of the prior art by providing a slow wave antenna structure having unique and novel tuning and impedance adjustments in addition to having an element which is electrically λ/4 but physically less than λ/4.

SUMMARY OF THE INVENTION

The slow wave antenna of the present invention provides a shortened antenna element which is constructed from an open surface slow wave guiding structure thereby realizing an efficient antenna element structure which is less than a small fraction of the physical size of a λ/4 antenna.

According to one embodiment of the present invention, there is provided a slotted pipe with a helically wound center conductor disposed therein, the slotted pipe being movable with respect to the helically wound center conductor, the helically wound center conductor wound on a core and connected to a source of RF energy, and the slotted pipe supported substantially along the entire length of the helically wound center conductor and extending slightly therebeyond at either end and dielectrically supported away from the helical coil whereby the driving point impedance is varied by changing the helical center conductor coil diameter and the pipe size, thereby changing the ratio of the distributed capacitance to distributed inductance and tuning is varied by a variable capacitor between the distributed capacitance common and RF ground or by moving the slotted pipe with respect to the helical coiled conductor.

According to another embodiment of the present invention, there is provided a slow wave antenna having a helical element with a plane capacitance structure disposed adjacent to the helically wound coil and supported and insulated therefrom whereby the helically wound coil is substantially parallel to the capacitive conductive sheet and tuning is provided by changing the spacing between the conductive sheet and the helically wound coil.

One significant aspect and feature of the present invention is a physically very small antenna element which is realized for a predetermined operating frequency. An element is constructed such as a λ/4 element, by way of example and for purposes of illustration only and not to be construed as limiting of the present invention, and physically is less than a very small fraction of λ/4 in size.

Another significant aspect and feature of the present invention is a slow wave antenna element which has a very low Q and hence a very broad bandwidth. Voltage standing wave ratios of less than 2:1 can be realized across entire band allocations such as the 20-meter amateur band. Radiation resistance, Q, and physical side tradeoffs are more readily recognizable with the two embodiments of the present invention as disclosed but also pertain to other physical embodiments which utilize the teachings of the present invention in this patent.

An additional significant aspect and feature of the present invention is an antenna element which can be easily tuned by changing the distributed capacitance of the slow wave helical structure or by adding capacitance from the distributive capacitance common to the RF common, or by changing the distributed inductance.

Having thus described embodiments of the present invention, it is a principal object hereof to provide a slow wave antenna element and structure.

An object of the present invention is a slow wave antenna structure which lends itself to communications transmissions and receptions, particularly in the high-frequency and very high frequency spectrum.

Another object of the present invention is a slow wave antenna element which can be utilized for both transmitting and receiving in communications electromagnetic propagations.

An additional object of the present invention is a slow wave antenna structure which is easily tuned without requiring complex electromechanical adjustments.

BRIEF DESCRIPTION OF THE DRAWINGS

Other objects and many of the attendant advantages of this invention will be readily appreciated as the same becomes better understood by reference to the following detailed description when considered in connection with the accompanying drawings, in which like reference numerals designate like parts throughout the figures thereof and wherein.

DESCRIPTION OF PREFERRED EMBODIMENTS

Figure 1:
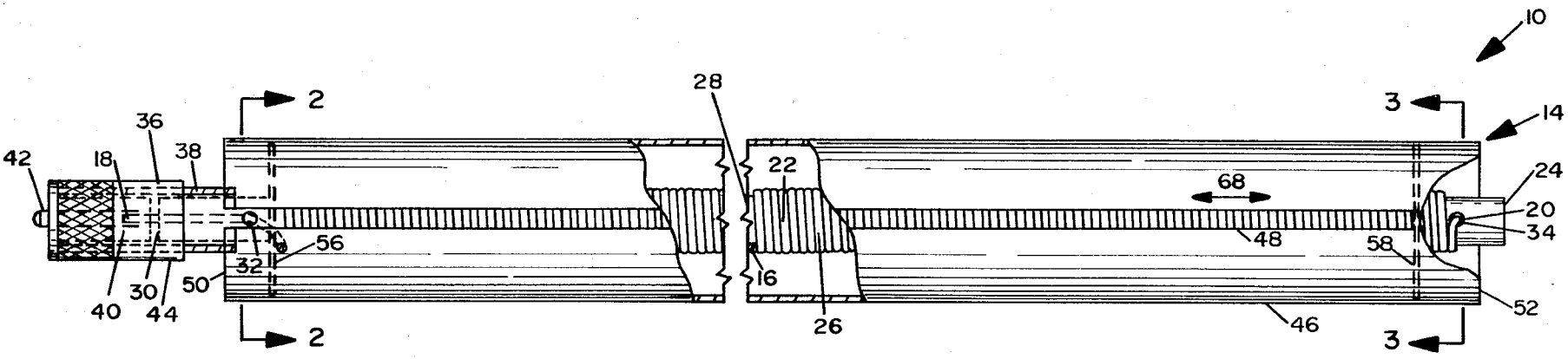
FIG. 1 illustrates a plan view of a slow wave antenna structure including a slotted pipe with a helically wound center conductor.

FIG. 1, which illustrates a plan view of a slow wave antenna 10, illustrates a helically wound conductor 12 with a slotted pipe 14 positioned thereabout and as now described in detail. The helically wound conductor 12 includes a length of conductor 16 approximately $\lambda/2$ in length where the conductor is magnet wire, insulated wire, or other suitable conductor wound from end 18 to end 20 along an axial length 22 of a finite diameter 24 forming a helically wound conductor 26. A cylindrical dielectric member 28 such as a finite length of dowel, plastic tubing or other like dielectric material having a hole 32 and an end 30 accommodates one end 18 of the conductor where the other end 20 of the conductor 16 positions adjacent to the end 34 of the cylindrical member 28. An RF connector such as a coaxial connector 36—and in this particular illustration a PL-259 by way of example and for purposes of illustration only—supports the end 30 of the cylindrical member 28 in the inner diameter of the barrel 38. The end 30 abuts up against a dielectric 40 of the connector 36 and the end 18 of the conductor 16 secures and is soldered to a pin 42 of the connector 36. A threaded member 44 threadably engages over the threaded barrel 38 of the connector 36.

The slotted cylindrical member 14 includes a cylindrical member 46 such as an aluminum tubing with a longitudinal slot 48 running the entire length of the cylindrical member 46 from end 50 to end 52. Dielectric washers 56 and 58 such as plastic or other dielectric material support and space the cylindrical member 46 from the helically wound conductor's outer diameter 26.

A mid section of the figure shows the cylindrical member 46 broken away exposing the helically wound conductor outer diameter 26, the conductor 16, and the dielectric cylindrical member 28.

Figure 2:
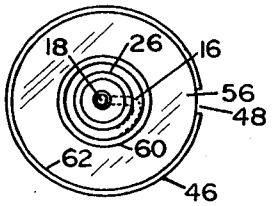
FIG. 2 illustrates a sectional view taken along line 2—2 of FIG. 1.

FIG. 2 illustrates a sectional view taken along line 2—2 of FIG. 1 of the slow wave antenna. All numerals correspond to those elements previously described. Particular attention is drawn to the end 18 of the conductor 16 which thereby forms the helical coil 26. Also, the slot 48 is positioned in the cylindrical member 46 and spaced from the helical coil 26 by the dielectric spacer 56. Dielectric spacer 56 includes an inner diameter 60 and an outer diameter 62 and is of a finite thickness.

Figure 3:
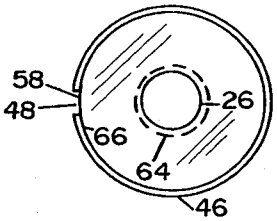
FIG. 3 illustrates a sectional view taken along line 3—3 of FIG. 1.

FIG. 3 illustrates a sectional view taken along line 3—3 of FIG. 1 where all numerals correspond to those elements previously described. Particularly, the dielectric washer 58 includes an inner diameter 64 and an outer diameter 66 and a finite thickness. The outer diameter 66 of the washer frictionally engages with respect to the inner diameter of the cylindrical member 46 while the inner diameter 64 of the washer engages over the windings of the helically wound conductor 26. The same engagement principles which apply to dielectric washer 58 are applicable to dielectric washer 56 for supporting the cylindrical member 46 about the helical coil 26.

Figure 4:
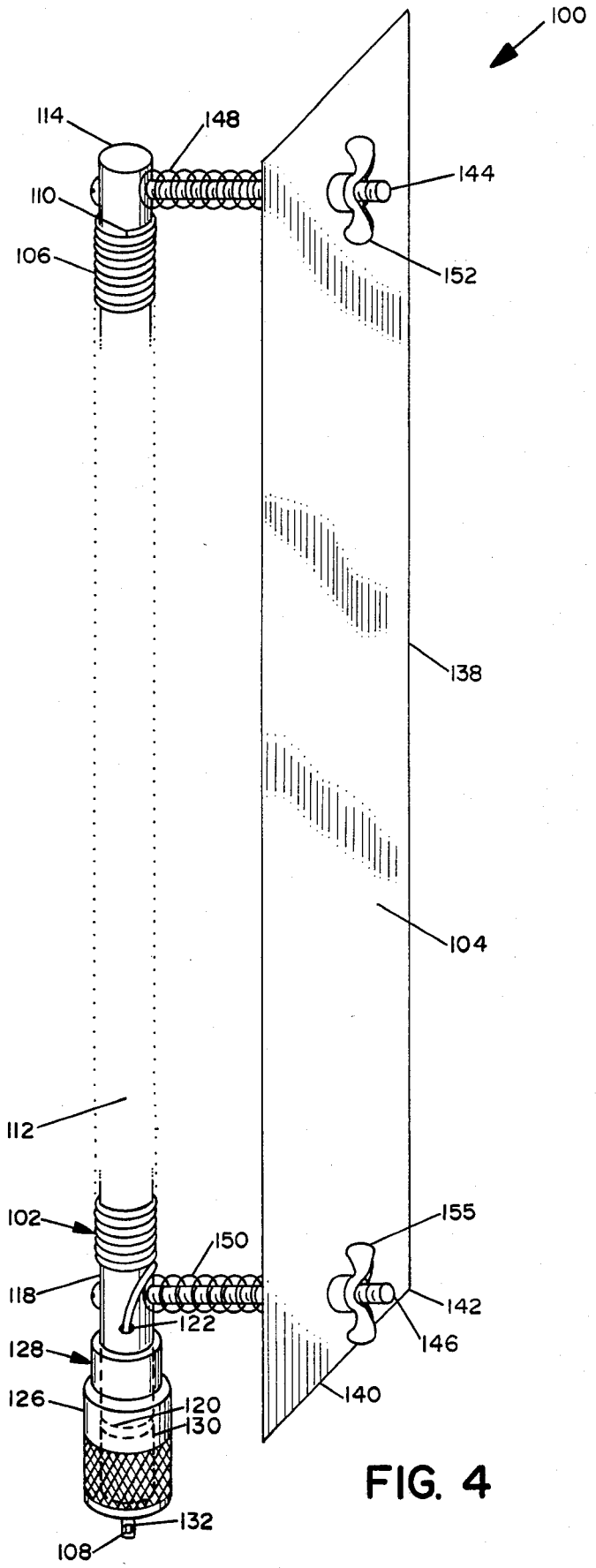
FIG. 4 illustrates a slow wave antenna structure of a helical element with plane capacitance structure, the second embodiment; and, FIG. 5 illustrates an electrical schematic diagram of the slow wave antenna.

FIG. 4 illustrates a second embodiment of a slow wave antenna including a helically wound conductor 102 and a rectangular capacitive plate 104. The helically wound conductor structure 102 is identical to that of the helically wound conductor 12 but for purposes of illustration is now described in detail. The helically wound conductor 102 includes a conductor such as magnet wire, insulated wire, etc., approximately $\lambda/2$ in length and wound helically about a longitudinal axis 112 forming a helically wound coil 106 of a constant finite diameter 114. A cylindrical dielectric member 118 supports the helically wound coil 106 and has an end 120 which secures into a barrel 128 of a coaxial connector 126 such as a PL-259. The end 120 of the cylindrical member 118 includes a hole 122 for supporting one end 108 of the conductor 106 and the end 120 abuts up against a dielectric member 130 of the connector 126. The end 108 of conductor 106 secures and solders into a pin 132 of connector 126.

A capacitive plate member 104 is rectangular by geometry, by way of example and for purposes of illustration only and not to be construed as limiting of the geometrical relationship of the capacitive member with respect to the helically wound conductor 102. The rectangular capacitive plate 104 includes a longitudinal length 138, a short width 140 and a finite thickness 142. Bolts 144 and 146, springs 148 and 150, and wing nuts 152 and 155 adjustably space the plate 104 from the member 118 and are adjustable with respect thereto.

Mode of Operation

The slow wave antennas 10 and 100 can be driven with RF energy against a ground or other counterpoise to realize vertical antennas. The antennas can be made to resonate at electrical lengths of $\lambda/4$, $\lambda/2$ or other convenient antenna radiating wavelengths. The slow wave antennas can also be incorporated into antenna array configurations and phased accordingly.

Figure 5:
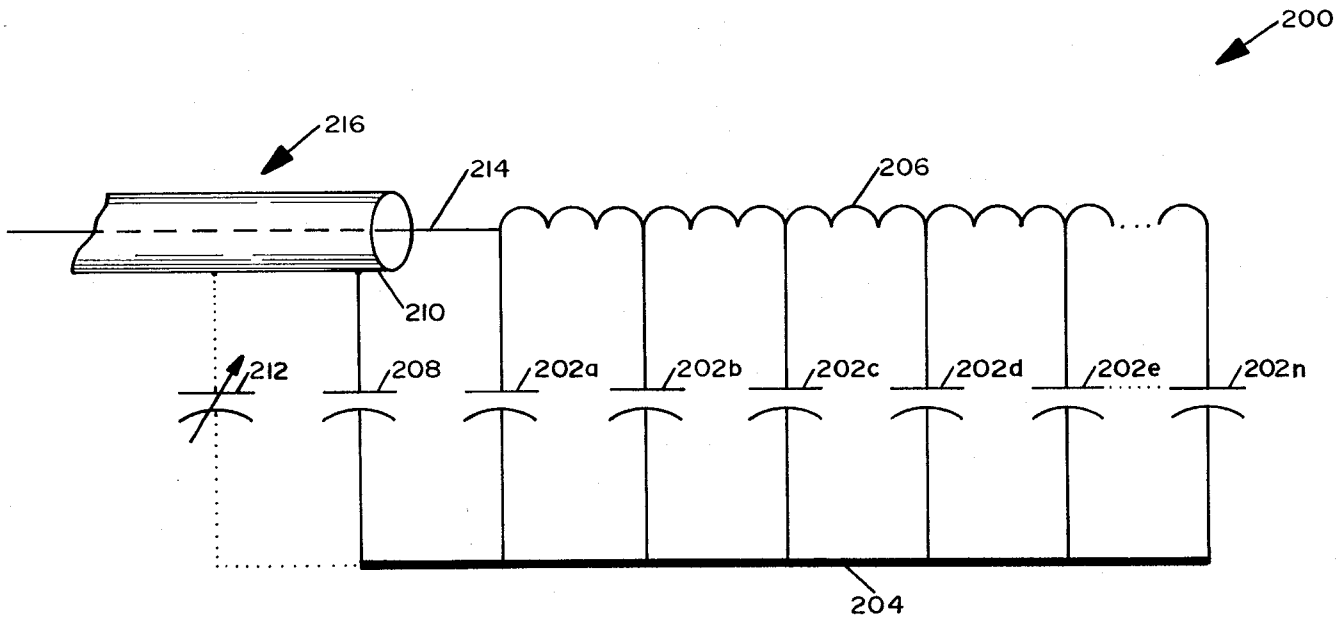

FIG. 5 illustrates an electrical schematic diagram 200 of the slow wave antennas 10 and 100. Capacitors **202*a*–202*n* represent distributed capacitance to the open surface. Line 204 represents the open surface distributed capacitance common. The distributed capacitance to the open surface is presented by the windings of the helical coil. Inductor 206 is the distributed inductance along the helical coil. Capacitor 208 is the capacitance between the open surface distributed capacitance common and the RF common. A variable capacitor 212 illustrated as being connected in dashed lines can be added between the capacitance common 204 and the RF common 210. The distributed capacitance 202 and the distributed inductance 206 connect to the RF excitation conductor 214. The RF excitation conductor and the RF common is illustrated as a coaxial cable 216** where the coaxial cable can be connected to either a transmitter or a receiver for selective modes of communication.

The Q of the antenna and the driving point impedance is varied by changing the ratio of the distributed capacitance to distributed inductance for the given predetermined geometry. The tuning of the antenna element, either 10 or 100, can be changed by changing the amount of distributed capacitance or capacitance from the distributed capacitance common to RF ground by variable capacitor 212. The tuning of the slow wave antenna 10 is accomplished by changing the position of the slotted cylindrical member 14 in FIG. 1 along the longitudinal length of the helical coil as indicated by arrow 68. The standing wave ratio is adjusted by sliding the cylindrical member 46 along the helical coil 26 where the washers 56 and 58 provide for the sliding engagement. The metallic cylindrical member 46 represents the distributed capacitance common 204 in FIG. 5. The tuning of slow wave antenna 100 is accomplished by moving the position of the conductive sheet 104 in distance with respect to the helical coil 106. The distributed capacitance represented by capacitors **202*a*–202*n* in FIG. 5 is varied by the position of the conductive sheet 104 with respect to the helical coil 106** by the spring biased bolts with winged nuts.

The slow wave antennas 10 and 100 are constructed through the use of distributed inductance and capacitance where the driving point impedance can change by varying the ratio of the distributed capacitance to the distributed inductance. Additional tuning can be accomplished by changing the capacitance between the distributed capacitance common 204 and the RF common 210 through a variable capacitor 212 of FIG. 5. The slow wave antennas 10 and 100 provide efficient antenna elements which can be constructed to be less than 1/50 of a wavelength in physical space. The use of linear capacitance and inductance distribution is not a prerequisite for the slow wave antenna structures but the use of linear capacitance and inductive distribution simplifies construction and eliminates the necessity of tapered pitch inductance winding. Non-linear inductance and/or capacitance distribution can be utilized in the construction in alternative embodiments under the teachings of this patent.

Representative antennas include a first antenna for use in the forty-meter portion of the high-frequency spectrum for use by way of example and for purposes of illustration only as a ground plane vertical. The antenna would be no longer than 90 cm in length and no larger than 3 cm in diameter. In the ten-meter band of the HF spectrum, the $\lambda/4$ vertical reduces to no longer than 14 cm in length and no larger than 1.6 cm in diameter. These antennas would take the geometry of the first embodiment of FIGS. 1 through 3. The antenna for the 100 Mhz band of operation would be a $\lambda/4$ vertical having a length no longer than 7.5 cm and a diameter of no larger than 1 cm. This antenna would take the geometry of the second embodiment, FIG. 4. The antennas would be built with 18-gauge wire, either insulated or magnet wire, wound on a wooden dowel, be connected to a PL-259 coaxial connector, and utilize either an aluminum slotted pipe or an aluminum plate. Higher efficiency is obtainable with some increase in wire size and corresponding increase in size. These illustrations are by way of example only and are not to be construed as limiting the scope of this patent.

The slow wave antenna structures are realized in that all shortened elements are an approximation of a slow wave guiding structure. A shortened antenna element can be constructed from any open surface slow wave guiding structure with these two geometry configurations of FIGS. 1–3 and FIG. 4 representing two possible examples thereof. Other examples are foreseeable within the teaching and scope of this patent. It is important to note that the distributed capacitance provides for a shortened helically wound conductor at a predetermined resonance frequency. The resultant slow wave antenna has electrical properties which are similar to a $\lambda/4$ length of wire but in some respects the resultant antenna has better electrical properties than a $\lambda/4$ length of wire. For example, the slow wave antenna is broad band, and includes less detuning from conductive objects in the near field. The effective electrical length is changed by changing the distributed inductance or parallel distributed capacitance while the effect of driving radiation resistance is varied by changing the ratio of distributed inductance to distributed capacitance. The slow wave antenna does not resonate at exact harmonics of the fundamental but does resonate at higher frequencies different from the harmonics of the fundamental. The radiation pattern changes with the tuning. Most importantly, the slow wave antenna is physically short in structure.

The antenna can be constructed from any electrical components yielding a slow wave on a structure that exhibits electrical properties of a single wire. Such an example would be substituting a high mu magnetic material around a wire conductor spaced from a conductive surface. A single wire delay line could also be utilized as long as the slow wave structure or delay line is similar in electrical properties to that of FIG. 5. The wavelengths of operation include but are not limited to $\lambda/4$, $\lambda/2$, $5\lambda/8$ and $\lambda$.

I claim:

1. Antenna for an RF communications device comprising:

a. means providing a slow wave structure for radio frequency energy and connected to said communications device, said slow wave structure being symmetrical about an axis and including means of a distributed capacitance and distributed inductance; and, b. continuously slotted cylindrical means for varying the driving point impedance of said slow wave structure by varying the ratio of said distributed capacitance to said distributed inductance and adjustably slidable and positioned about said axis of said slow wave structure means by a dielectric washer at each end thereof whereby said slotted cylindrical varying means changes said distributed capacitance thereby providing an antenna having a length less than an equivalent free space length.

2. Antenna of claim 1 wherein said slow wave structure means comprises a helical coil about a dielectric rod.

3. Antenna of claim 2 wherein said helical coil is an antenna element.

4. Antenna of claim 1 comprising variable capacitance means connected between a common ground of said distributed capacitance and RF ground for tuning of said antenna.

5. Antenna for an RF communications device comprising:

a. means providing a slow wave structure for radio frequency energy and connected to said communication device, said slow wave structure including means of a distributed capacitance and distributed inductance; and, b. flat geometrical means for varying the driving point impedance of said slow wave structure by varying the ratio of said distributed capacitance to said distributed inductance and adjustably vertically positioned parallel to an axis of said slow wave structure means and adjacent thereto and including bolt and wing nut means and a spring over said bolt and nut means for biasing said flat geometrical means from said slow wave structure means whereby said flat geometrical varying means changes said distributed capacitance thereby providing an antenna having a length less than an equivalent free space length.

6. Antenna of claim 5 wherein said slow wave means comprises a helical coil about a dielectric rod.

7. Antenna of claim 6 wherein said helical coil is an antenna element.

8. Antenna of claim 5 comprising variable capacitance means connected between a common ground of said distributed capacitance and RF ground for tuning of said antenna.

* * * * *